US010107465B2

(12) United States Patent
Toner

(10) Patent No.: US 10,107,465 B2
(45) Date of Patent: Oct. 23, 2018

(54) FLAGPOLE FINIAL ASSEMBLY

(71) Applicant: Gary L. Toner, Lancaster, NY (US)

(72) Inventor: Gary L. Toner, Lancaster, NY (US)

( * ) Notice: Subject to any disclaimer, the term of this patent is extended or adjusted under 35 U.S.C. 154(b) by 99 days.

(21) Appl. No.: 15/365,003

(22) Filed: Nov. 30, 2016

(65) Prior Publication Data

US 2017/0152998 A1 Jun. 1, 2017

Related U.S. Application Data

(60) Provisional application No. 62/261,672, filed on Dec. 1, 2015.

(51) Int. Cl.

| | |
|---|---|
| ***F21S 9/03*** | (2006.01) |
| ***F21V 33/00*** | (2006.01) |
| ***F21S 8/08*** | (2006.01) |
| ***F21V 23/00*** | (2015.01) |
| ***E04H 12/32*** | (2006.01) |
| *F21Y 115/10* | (2016.01) |
| *F21W 121/00* | (2006.01) |
| *F21V 21/116* | (2006.01) |

(52) U.S. Cl.

CPC ..... *F21S 9/032* (2013.01); *E04H 12/32* (2013.01); *F21S 8/08* (2013.01); *F21V 23/002* (2013.01); *F21V 33/00* (2013.01); *F21V 21/116* (2013.01); *F21W 2121/00* (2013.01); *F21Y 2115/10* (2016.08)

(58) Field of Classification Search

CPC .. F21S 9/032; F21S 8/08; E04H 12/32; F21V 23/002; F21V 33/00

See application file for complete search history.

(56) References Cited

U.S. PATENT DOCUMENTS

| | | | | |
|---|---|---|---|---|
| 1,878,447 A * | 9/1932 | Sutphen | E04H 12/32 | 116/173 |
| 3,752,975 A * | 8/1973 | Meyer | E04H 12/32 | 116/173 |
| 6,455,767 B1 * | 9/2002 | Muller | F21S 9/037 | 116/173 |
| 8,215,807 B1 * | 7/2012 | Brunesti | G09F 17/00 | 362/431 |
| 8,746,928 B2 * | 6/2014 | Morris | E04H 12/32 | 362/249.06 |
| 2005/0083693 A1 * | 4/2005 | Garrett | G09F 17/00 | 362/253 |

* cited by examiner

*Primary Examiner* — Anabel Ton

(74) *Attorney, Agent, or Firm* — Del Vecchio and Stadler LLP

(57) ABSTRACT

A flagpole finial assembly is provided for lighting of a flag suspended from the flagpole. The flagpole finial assembly has cover final half that is supported on a base finial half. The base finial half has a base finial half inner surface and an opposed base finial half outer surface. The base finial half is formed with a LED support wall or a plurality of LED support walls that extend into the base finial half and that define LED recesses. Each LED support wall defines a light opening into which a LED is fitted such the LED extends from the base finial half and is disposed in the LED recess. The LEDs are wired to a power cord that extends through the flagpole and exits the flagpole. The power cord is powered via a power adapter or a solar panel wired to a rechargeable battery pack.

18 Claims, 4 Drawing Sheets

FLAGPOLE FINIAL ASSEMBLY

CROSS REFERENCE TO RELATED APPLICATION

This application claims the benefit of U.S. Provisional Patent Application No. 62/261,672 filed on Dec. 1, 2015 the entire contents and disclosure of which is hereby are incorporated herein by reference.

BACKGROUND

Many homes, businesses and governmental entities fly flags or have flagpoles that can be used to fly flags. Of course, at nighttime most flags are not visible because there is no sunlight to illuminate the flags. To overcome this, some businesses, homeowners and governmental agencies shine ground lights on the flags so that they can be illuminated at night, but this can result in imperfect results. This is because the flags are oftentimes swaying in the wind, and as a result the flags will only be illuminated when the flags waves or passes through the beam of light emitted from the ground lighting. In other words, even with ground lighting the flags can appear black or simply not visible during the night.

In addition, when there is little or no wind the ground lighting will cast some light on the flag, but the flag will still appear as a mass of illuminated fabric at the top of the flagpole. In these conditions the color and appearance of the flag is difficult, if not impossible, to make out when the flag is viewed from the ground.

Past attempts to illuminate flags includes use of a devices that are rotatably mounted on the top of the flagpole and that include a means for lighting. As the flag is blown in different directions the device rotates with the flag. However, these devices have overly complex internal and external structures. In addition, there is a high probability that these rotatable devices will become non-functional or otherwise inoperative when there is snow and ice present on top of the flagpole, because rotation will be impossible.

Thus, there is a need for a way to illuminate flags during the entire night. There is also a need for the flag to be fully illuminated at all times throughout the night, regardless of whether or not the wind is blowing and regardless of the weather and environmental conditions. There is also a need for the device to be easy to manufacture while at the same time have a low production cost.

SUMMARY

A flagpole final assembly is provided for lighting a flag suspended from a flagpole, a post or other structure. The flagpole finial assembly has cover and base finial halves and the cover finial half is supported on the base finial half.

The base finial half has opposed interior and exterior base surfaces. The base finial half is formed with at least one light emitting diode (hereinafter referred to as LED in both specification and claims) support wall that extends inwardly into the base finial half such that the LED support wall protrudes from the interior base surface of the base finial half. Thus, the LED support wall defines a LED recess sized to accommodate a LED therein. In one of the preferred embodiments there are eight (8) LED support walls that are spaced equal distances from one another. Each of the LED support walls defines a LED opening and LEDs are fitted in the LED openings such that they extend from the base finial half and are disposed in the LED recesses. In other preferred embodiments there may be two or more LED support walls for supporting the LEDs. The LEDs are supported is such a way that they are they are recessed relative to the surrounding exterior base surface of the base finial half.

The LEDs are wired to a power cord. In particular, the power cord extends from a power source, through the flagpole, through a pole connector, through a finial connector and to the LEDs. The power cord connects to a power adapter and the power adapter connects to the existing power grid, or the power source may be embodied as a solar panel wired to a rechargeable battery pack, such that the rechargeable battery pack delivers power to the power cord and the LEDs. When the LEDs are powered the flag is illumined at all times regardless of whether or not the wind is not blowing because the flag is supported on the flagpole below flagpole finial assembly. In addition, the flagpole finial assembly is capable of functioning in all weather conditions.

BRIEF DESCRIPTION OF THE DRAWING FIGURES

DETAILED DESCRIPTION

Figure 1:
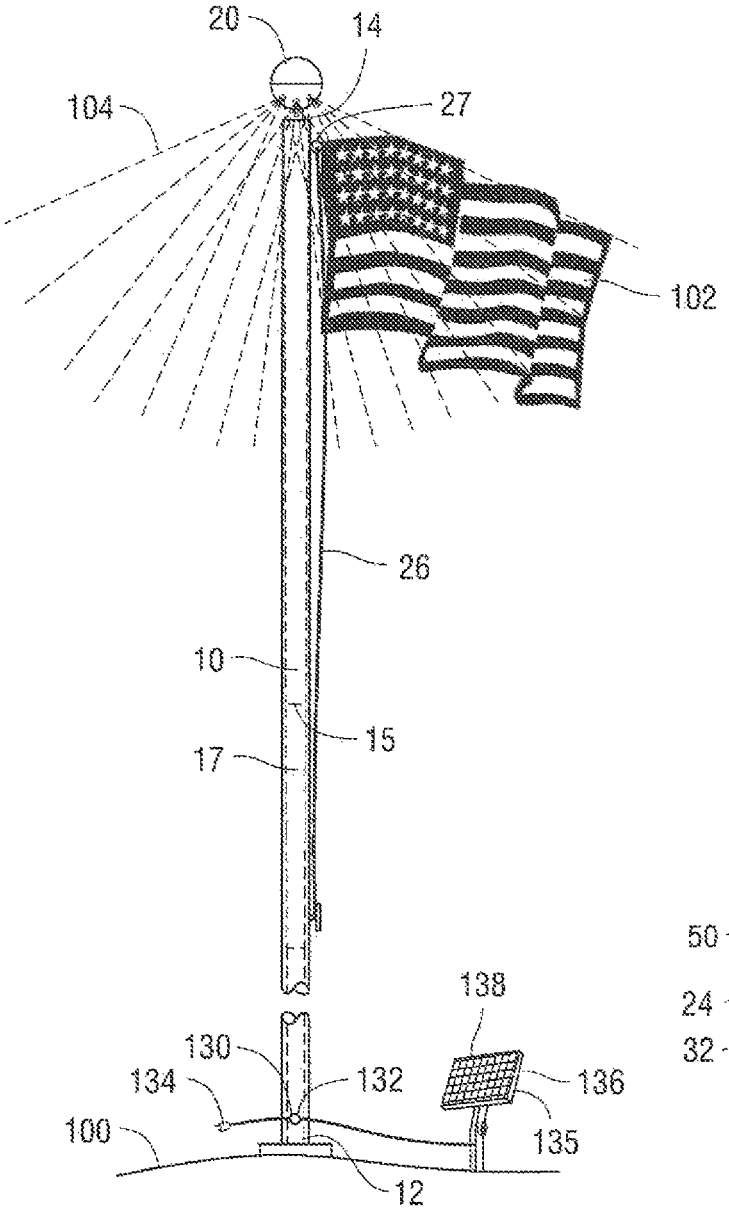
FIG. 1 is a front view of a flagpole supported on the ground and wherein the flagpole supports a flagpole finial assembly.
Figure 2:
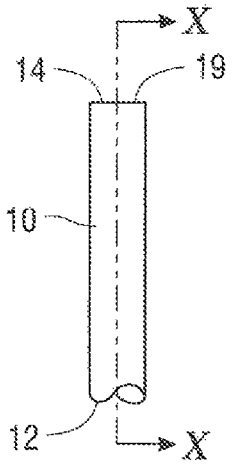
FIG. 2 is a front view of a portion of the flagpole showing the finial end thereof.
Figure 3:
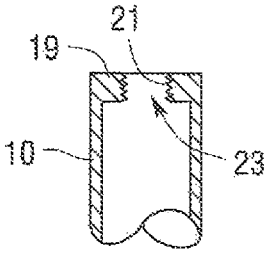
FIG. 3 is a sectional view of a portion of the flagpole taken along line X-X of FIG. 2.

FIGS. 1-3 show a flagpole 10 having a ground end 12 and an opposed finial end 14. The ground end 12 of the flagpole 10 is submerged in the ground 100 in FIG. 1 such that the flagpole 10 extends vertically from the ground 100 as shown. The flagpole 10 is shaped like a cylinder defines a flagpole interior 17. The flagpole 10 is shaped like an elongated tube and in another one of the preferred embodiments the flagpole 10 is telescopic and has telescopic segments (shown in dashed line) commonly designated 15 that can be extended and retracted. Telescoping flagpoles are well known to those having ordinary skill in the art and are therefore not described in greater detail herein.

As shown in FIGS. 2 and 3 an end cap 19 is fitted in the flagpole 10 at the finial end 14 and is held in place with a friction fit, or may be secured to the flagpole 10 with a weld, threads or fasters. The end cap 19 has an internal thread 21, and the internal thread 21 defines an end cap opening 23. A flag 102 is supported on the flagpole 100 in a convention manner, and supporting flags 102 on flagpoles 10 such that the flag can be raised and lowered with a rope 25 and pulleys 27 is well know to those have ordinary skill in the art and therefore this is not described in greater detail herein. In addition, as shown in FIG. 1, the flagpole 10 supports a flagpole finial assembly 20 that is threaded to the end cap 19 as will be describe presently.

Figure 4:
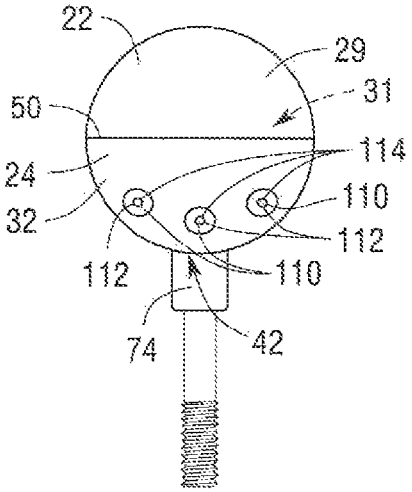
FIG. 4 is a front view of the flagpole finial assembly showing a base finial half and a cover finial half.
Figure 5:
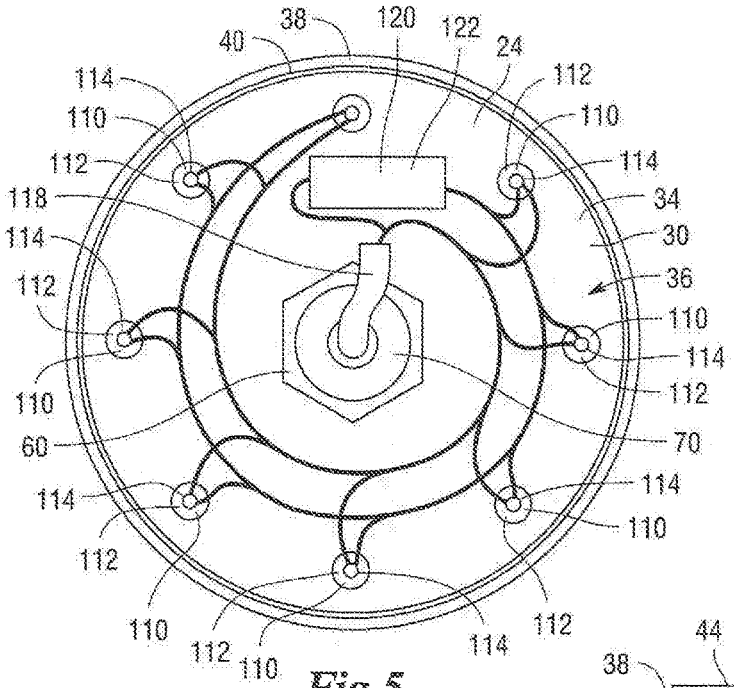
FIG. 5 is a top view of the base finial half when the cover finial half is not present and eight LEDs are shown.
Figure 5A:
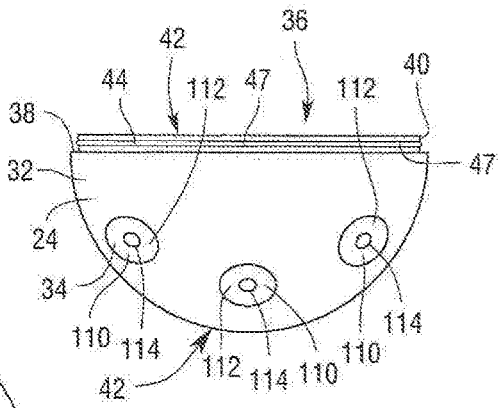
FIG. 5A is a front view of the base finial half.

As shown in FIG. 4 the flagpole finial assembly 20 has a cover final half 22 and a base finial half 24, each of which are in the shape of a half sphere. After the cover finial half 22 and base finial half 24 have been brought together they form a sphere shaped body 29 that defines a finial interior 31. FIG. 5 is a top view of the base finial half 24 when the cover finial half 22 is not present. FIG. 5A is a side view of the base finial half 24, and the base finial half 24 has opposed interior and exterior base surfaces 30, 32, and a spherical portion 34 that is shaped like half a sphere, and the spherical portion 34 defines a base interior 36 (FIG. 5). The base finial half 24 also has an annular stop wall 38 that extends inwardly from the spherical portion 34. Extending from the annular stop wall 38 is a surrounding engagement wall 40 that defines a base final half opening 42 that leads to the base interior 36. The cover final half 22 is pressed or fitted onto the surrounding engagement wall 40 of the base finial half 24. In one of the preferred embodiments the surrounding engagement wall 40 may be formed with a annular engagement bulge 44 to enhance the engagement of the cover finial half 22 with the base finial half 24 when the cover finial half 22 is pressed or fitted onto the base finial half 24.

Figure 6:
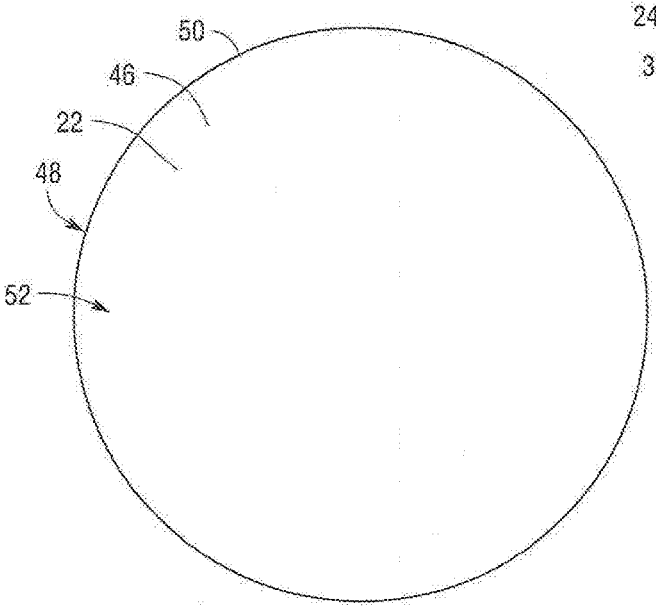
FIG. 6 is a bottom view of the cover finial half looking into the cover finial half.

FIG. 6 is a view looking into the cover finial half 22, and the cover finial half 22 has opposed inner and outer cover half surfaces 46, 48 that meet at a finial cover edge 50. The cover finial half 22 defines a finial cover recess 52. The cover finial half 22 is adapted to be fitted over the surrounding engagement wall 40 of the base finial half 24 in a close fitting type relationship, such that a friction fit holds the cover final half 22 and a base finial half 24 together as described above. In particular, the inner cover half surface 46 is slid over the surrounding engagement wall 40 and held in place with a friction fit, and the annular stop wall 38 prevents further sliding because the finial cover edge 50 abuts the stop wall 38. In addition, an adhesive or waterproof adhesive, commonly designated by reference numeral 47 herein, may be used that coats the surrounding engagement wall 40 such that both a friction fit and the adhesive 47 secure the base finial half 24 to the cover finial half 22. In addition, if the surrounding engagement wall 40 is embodied to have the above-described engagement bulge 44, then the engagement bulge 44 will further enhance the friction fit. In other preferred embodiments the cover final half 22 may have internal threads and the surrounding engagement wall 40 may have external threads and the two are threaded together, and in other preferred embodiments fasteners or other types of interlocks may be used to join or connect the cover and base finial halves 22, 24. When the cover final half 22 and a base finial half 24 are held as described above and shown in FIG. 4, together they define the finial interior 31.

Figure 7A:
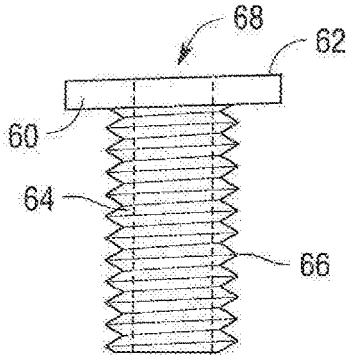
FIG. 7A is front view of a finial connector.
Figure 7B:
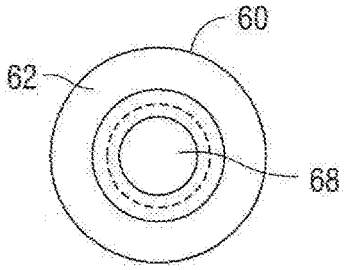
FIG. 7B is a top view of the finial connector.
Figure 7C:
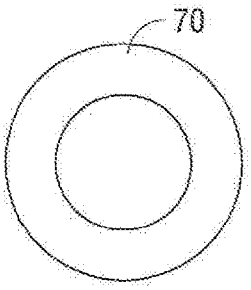
FIG. 7C is a top view of a connector washer.
Figure 8A:
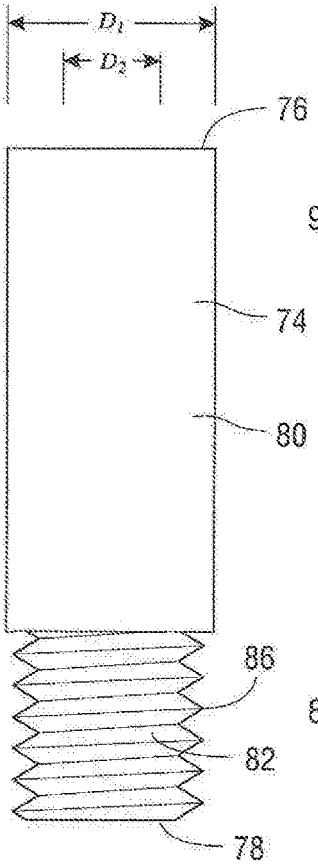
FIG. 8A is front view of a pole connector.
Figure 8B:
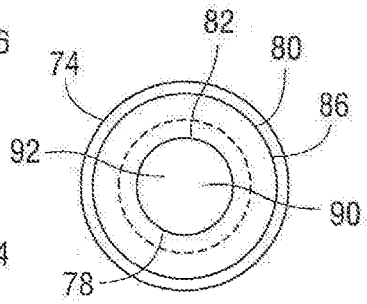
FIG. 8B is a bottom view of the pole connector.
Figure 8C:
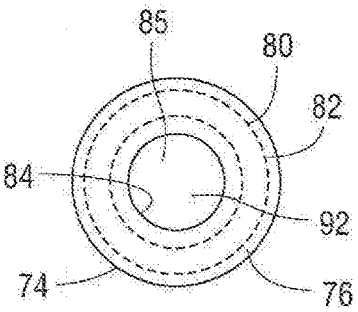
FIG. 8C is a top view of the pole connector.
Figure 8D:
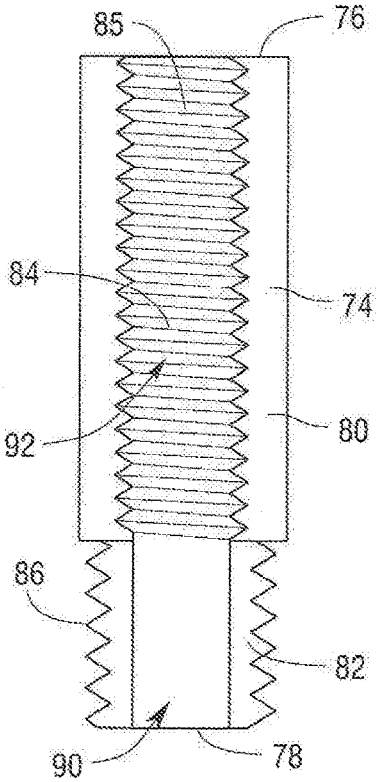
FIG. 8D is a sectional view of the pole connector.

As shown in FIGS. 7A and 7B, the flagpole finial assembly 20 includes a finial connector 60 having a head portion 62 and a shaft portion 64, and the shaft portion 64 has an external thread 66. A connector bore 68 is defined in the head portion 62 and the shaft portion 64, and the connector bore 68 extends completely through the finial connector 60. A connector washer 70 (FIG. 7C) is provided and it has substantially the same dimensions as the head portion 62 such that it can be supported on the head portion 62 and secured to the head portion 62 with an adhesive 47 as will be described presently.

As shown in FIGS. 8A-8D, the flagpole finial assembly 20 includes a pole connector 74 having opposed first and second pole connector ends 76, 78. The pole connector 74 has a first pole connector portion 80 from which extends a second pole connector portion 82 and in one of the preferred embodiments the pole connector 74 is a one-piece body. The first pole connector portion 80 has a first diameter designated D1 and has an internal pole connector thread 84 that defines a first pole connector portion passage 85. The second pole connector portion 82 has a diameter designated D2 that is less than D1 and has an external pole connector thread 86. The second pole connector portion 82 defines a second pole connector portion passage 90 that extends to and meets with the first pole connector portion passage 85. Together, the first and second pole connecter passages 85, 90 define a pole connector bore 92 that extends completely though the pole connector 74.

Figure 9:
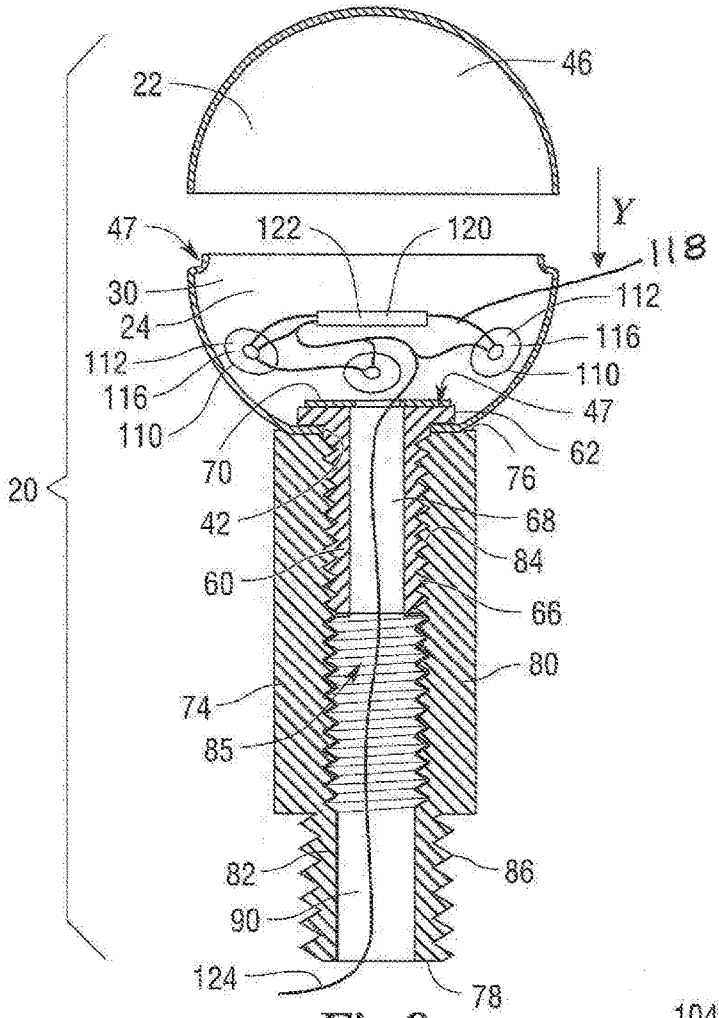
FIG. 9 is an expanded sectional view of the flagpole finial assembly as the cover finial half is moved onto the base finial half as indicated by the arrow designated Y.

FIG. 9 is an expanded sectional view of the flagpole finial assembly 20 showing the finial connector 60 threaded to the pole connector 74. In particular the shaft portion 64 of the finial connector 60 extends through the base final half opening 42 defined in the base finial half 24, and the external thread 66 of the finial connector 60 is threaded to the internal pole connector thread 84. In addition, as shown the first pole connector end 76 abuts the exterior base surface 30 of the base finial half 24, and the connector head portion 62 of the finial connector 60 abuts the interior base surface 30. This results in the pole connector 74 being secured to the base finial half 24. The arrow designated Y indicates the movement of the cover finial half 22 as it is pressed or forced onto the base finial half 24. The connector washer 70 is disposed on the head portion 62 and the connector washer 70 is secured to the head portion 62 with the adhesive 47. In other preferred embodiments the connector washer 70 is absent. The flagpole finial assembly 20, and in particular the external pole connector thread 86 is threaded to the internal thread 21 of the end cap 19 that is supported on the flagpole 10, such that the flagpole finial assembly 20 is secured to and supported on the flagpole 10.

Figure 10:
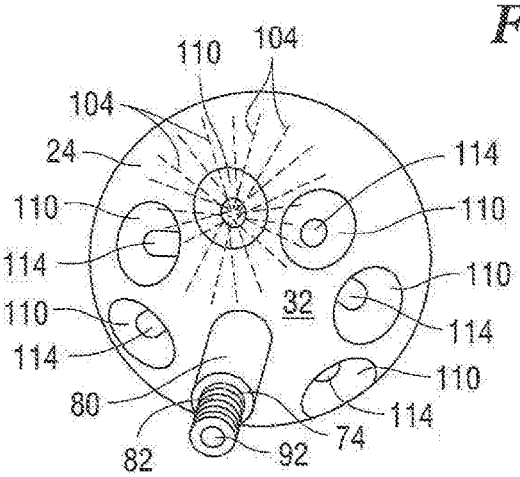
FIG. 10 is a bottom perspective view of flagpole finial assembly.
Figure 11:
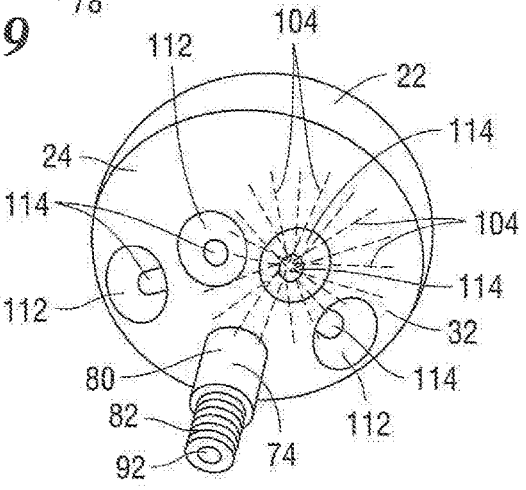
FIG. 11 is another bottom perspective view of flagpole finial assembly.

The flagpole finial assembly 20 also includes LEDs 110. As shown in FIGS. 4, 5, 5A, 9, 10 and 11, the base finial half 24 has formed therein LED support walls commonly designated 110 that extend into the base finial half 24 and thus extend into the finial interior 31. In particular, the LED support walls 110 extend inwardly relative to the exterior base surface 32 and protrude outwardly relative to the interior base surface 30 of the base finial half 24 to thus define LED recesses 112 in the base finial half 24. Each of the LED support walls 110 defines a LED opening 114, and the LED opening 114 is sized such that a LED 116 can be accommodated or fitted in the LED opening 114. Thus, the LED 116 is disposed in the LED recess 112 formed in the base finial half 24. In one of the preferred embodiments there are eight LED support walls 110 that are spaced equal distances from one another and each supports an LED 116, but in other preferred embodiments there may be more or less than eight LED support walls 110 such that more or less than eight LEDs 116 may be used in the flagpole finial assembly 20. As shown in FIGS. 5, 10 and 11, the LEDs 110 are spaced from another such that together they form the shape of a circle or ring of LEDs 110 that extends around the base finial half 24.

In another preferred embodiment wherein there is a flagpole 10 that is supported on a porch post (not shown), and there may be only one, two or three LED support walls 110 formed in the base finial half 24 for supporting LEDs 116. In such a configuration there may be only be one LED 116 used, but if three LEDs 116 were to be used, then the flagpole finial assembly 20 would appear like what is shown in FIG. 4, with the understanding that those would be the only LEDs 116 supported by the base finial half 24. In such an embodiment the light 104 emitted from the LED(s) 116 is directed on or focused on the flag 102 and stray light is not emitted from the flagpole finial assembly 20 onto neighboring properties. Thus, the number and positioning of the LED support walls 110 may be varied to accommodate different lighting situations and needs.

The LEDs 116 are held in place with a friction fits made between the LEDs 116 and the annular LED walls 111 or may be held in place with a combination of a friction fits and adhesives or waterproof adhesives 47. As shown in FIGS. 5 and 9, the flagpole finial assembly 20 also includes a wiring harness 118 that provides power to the LEDs 116, and includes the associated LED electronics 120 for the LEDs 116 that may include a resistor for controlling power flow to the LEDs 116. Wiring harnesses and LEDs are well known to those having ordinary skill in the art and the powering of LEDs is well known to those having ordinary skill in the art and therefore they are not described herein in greater detail. The LEDs 116 can be embodied to be white, or may be made to have virtually any color, for example white, green and blue, and can be embodied as flashing LEDs 116.

The flagpole finial assembly 20 also includes a power cord 124, and the wiring harness 118 and the LEDs 116 receive power from the power cord 124. As shown in FIG. 9, the power cord 124 extends into the finial interior 31 where it is wired to the wiring harness 118 and the LEDs 116. The power cord 124 extends from the finial interior 31 and through the connector washer 70, through the connector bore 68, through the base final half opening 42, through the first pole connector passage 85, through the second pole connector passage 90, through the cap opening 23 and through the flagpole interior 17. It is pointed out that where the power cord 124 passes through the base finial half opening 42 it may be coated with adhesive 47 such that the adhesive 47 coats the power cord 124, the connector washer 70, the connector head 60 and the surrounding base half interior surface 30, thus sealing off the finial interior 31 off from the external environment. In addition, the power cord 124 may be formed with a knot (not shown) where it extends into the finial interior 31 such that the power cord 124 is unable to move through the connector washer 70 or through the connector bore 68 and slide out of the finial interior 31. As shown in FIG. 1, the flagpole 10 has a flagpole cord opening 130 and a grommet 132 surrounds the flagpole cord opening 132 opening and the power cord 124 extends through the grommet 132 in a close fitting relationship. This stabilizes and protects the power cord 124 and prevents fluid from entering the flagpole interior 17. The flagpole finial assembly 20 includes a power adapter 134 from which the power cord 124 extends. The power adapter 134 can be plugged into a power source such as a wall socket or an extension cord thus powering the LEDs 116. Power adapters for use with LEDs 116 are well known to those having ordinary skill in the art and are therefore not described in greater detail herein. The power cord 124 can also be powered by a solar panel 135 with rechargeable battery pack unit 136 that includes a light sensor 138. The light sensor 138 is for causing the LEDs 116 to be powered or not powered off depending on current environmental light conditions, such that the LEDs 116 are automatically powered when a predetermined low light lever is detected. The use, operation and construction of solar panels, rechargeable battery packs and light sensors are well know to those having ordinary skill in the art and thus not described in greater detail herein.

In addition, as shown in FIGS. 1, 8 and 9, 10 and 11 the LEDs 116 are recessed relative to the exterior base surface 32 of the base finial half 24. This causes the light 104 emitted from the LEDs 116 to be cast on the flag 102 that is located or positioned below the flagpole finial assembly 20. As a result of having the LEDs 116 are recessed relative to the exterior base surface 32 such that the light 104 emitted by the LEDs 116 is focused or directed on the flag 102, that is, and the light 104 is confined by the LED support walls 110 such that the light is directed on the flag 102 as opposed to nearby objects. Thus, the LED support walls 110 prevent, to some degree, the light 104 from scattering.

In use and as shown in FIG. 1, when the flagpole finial assembly 20 is threaded to the end cap 19 and powered by the power cord 124 as described above, the LEDs 116 emit light 104 on the flag 102 such that regardless of whether the flag 102 is still or blowing in the wind it will be illuminated at all times during the night or low light conditions. In addition, that amount of stray light from the LEDs 116 is decreased due to the by the shape of the LED support walls 110, and the flag 102 is capable of being illuminated in all weather conditions.

It is pointed out that the although the flagpole finial assembly 20 is described herein in connection with flagpoles 10, it is to be understood that the flagpole finial assembly 20 can be mounted on virtually any structure or pole or post to provide light 104.

It will be appreciated by those skilled in the art that while the flagpole finial assembly 20 has been described in detail herein, the flagpole finial assembly 20 is not necessarily so limited and other examples, embodiments, uses, modifications, and departures from the embodiments, examples, uses, and modifications may be made to the flagpole finial assembly 20 without departing from the flagpole finial assembly 20 and all such embodiments are intended to be within the scope and spirit of the appended claims.

What is claimed:

1. A flagpole finial assembly capable of being supported on a flagpole, the flagpole final assembly comprising:

a cover final half;

a base finial half having opposed interior and exterior base surfaces and a surrounding engagement wall that defines a base finial half opening, and a LED support wall that extends inwardly from the exterior base surface and protrudes outwardly from the interior base surface and the LED support wall defines a LED recess and wherein the LED support wall defines a LED opening and an LED is disposed in the LED opening, and wherein the cover finial half is fitted on the base final half to define a finial interior;

a finial connector having a head portion and a shaft portion and the shaft portion has an external thread, and the head portion and the shaft portion define a connector bore and wherein shaft portion extends through the base finial half opening such that the head portion abuts against the interior base surface and the shaft portion extend outwardly from the exterior base surface; and, a pole connector having opposed first and second pole connector ends and having a first pole connector portion from which extends a second pole connector portion and wherein the first pole connector portion has an internal thread that defines a first pole connector portion passage and the external thread of the finial connector is threaded to the internal thread, such that the base finial half abuts the head portion of the finial connector and abuts the first pole connector end of the pole connector when the external and internal threads are tightened, and the second pole connector portion has an external pole connector thread and the second pole connector portion defines a second pole connector portion passage that extends to and meets with the first pole connector portion passage and wherein the second pole connector portion is supported on the flagpole.

2. The flagpole finial assembly according to claim 1 wherein the flagpole supports an end cap having an internal thread that that defines a cap opening and the end cap is threaded to the external pole connector thread such that the pole connector is supported on the flagpole.

3. The flagpole finial assembly according to claim 1 further including a power cord that extends through the first and second pole connecter passages and the connector bore and the power cord is wired to a wiring harness that is wired to the LED such that the LED can be powered.

4. The flagpole finial assembly according to claim 3 wherein the wiring harness has LED electronics that include a resistor.

5. The flagpole finial assembly according to claim 1 wherein the base finial half has eight LED support walls each supporting an LED and each spaced an equal distance from one another, and a power cord that extends through the first and second pole connecter passages and connector bore and the power cord is wired to a wiring harness that is wired to the eight LEDs such that the eight LEDs can be powered.

6. The flagpole finial assembly according to claim 1 wherein the base finial half has three LED support walls each supporting an LED and a power cord that extends through the first and second pole connecter passages and connector bore and the power cord is wired to a wiring harness that is wired to the three LEDs.

7. The flagpole finial assembly according to claim 1 wherein the pole connector is a one-piece body.

8. The flagpole finial assembly according to claim 1 wherein the base finial half has a stop wall that extends to a surrounding wall and the cover final half is fitted over the surrounding wall and abuts the stop wall and the cover finial half is held in place with a friction fit with the surrounding wall.

9. The flagpole finial assembly according to claim 3 wherein the flagpole defines a flagpole cord opening and the power cord extends through the cap opening, through the flagpole and through flagpole cord opening to an adapter and the adapter is powered from a power source in order to power the LED.

10. The flagpole finial assembly according to claim 3 wherein the flagpole defines a flagpole cord opening and the power cord extends through the cap opening, through the flagpole and through flagpole cord opening to a rechargeable battery that is wired to a solar panel such that the LED is powered by the rechargeable battery.

11. A method of lighting with a flagpole finial assembly, the method comprising the steps of:

providing a cover final half;

providing a base finial half having opposed interior and exterior base surfaces and a surrounding engagement wall that defines a base finial half opening, forming a LED support wall that extends inwardly from the exterior base surface and protrudes outwardly from the interior base surface, defining an LED recess in the support wall and defining an LED opening in the support wall and disposing an LED in the LED opening, and wherein the cover finial half is fitted on the base final half to define a finial interior;

providing a finial connector having a head portion and a shaft portion and providing the shaft portion with an external thread, and defining a connector bore in the head portion and the shaft portion and extending the shaft portion through the base finial half opening such that the head portion abuts against the interior base surface and the shaft portion extend outwardly from the exterior base surface; and, providing a pole connector having opposed first and second pole connector ends and having a first pole connector portion from which extends a second pole connector portion and providing the first pole connector portion with an internal thread that defines a first pole connector portion passage and threading the external thread of the finial connector to the internal thread, tightening the external and internal threads such that the base finial half abuts the head portion of the finial connector and abuts the first pole connector end of the pole connector, and providing the second pole connector portion with an external pole connector thread and the second pole connector portion defines a second pole connector portion passage that extends to and meets with the first pole connector portion passage and wherein the second pole connector portion is supported on the flagpole.

12. The method of lighting with a flagpole finial assembly according to claim 11 comprising the further step of providing an end cap and supporting the end cap on the flagpole and providing the end cap with an internal thread that that defines a cap opening and threading the end cap to the external pole connector thread such that the pole connector threaded to the flagpole.

13. The method of lighting with a flagpole finial assembly according to claim 12 further including providing a power cord and extending the power cord through the first and second pole connecter passages and the connector bore and providing a wiring harness wiring and wiring harness to the power cord and the LED such that the LED can be powered by the power cord.

14. The method of lighting with a flagpole finial assembly according to claim 13 wherein the wiring harness has LED electronics that include a resistor.

15. The method of lighting with a flagpole finial assembly according to claim 11 further including the step of providing the base finial half with eight LED support walls each supporting an LED and each spaced an equal distance from one another, and providing a power cord that extends through the first and second pole connecter passages and connector bore and the power cord is wired to a wiring harness that is wired to the eight LEDs in order to power the eight LEDs.

16. The method of lighting with a flagpole finial assembly according to claim 11 further including the step of providing the base finial half with a stop wall that extends to a surrounding wall and fitting the cover final half over the surrounding wall such that the cover finial half abuts the stop wall and where the cover finial half is held in place with a friction fit with the surrounding wall.

17. The method of lighting with a flagpole finial assembly according to claim 13 further including the steps of defining a flagpole cord opening in the flagpole and extending the power cord through the cap opening, through the flagpole and through flagpole cord opening to an adapter and the adapter is powered from a power source in order to power the LED.

18. The method of lighting with a flagpole finial assembly according to claim 13 further including the steps of defining a flagpole cord opening in the flagpole and extending the power cord through the cap opening, through the flagpole and through flagpole cord opening to a rechargeable battery that is wired to a solar panel such that the LED is powered by the rechargeable battery.

* * * * *